US009508351B2

(12) United States Patent
Kjoerling et al.

(10) Patent No.: US 9,508,351 B2
(45) Date of Patent: Nov. 29, 2016

(54) SBR BITSTREAM PARAMETER DOWNMIX

(75) Inventors: Kristofer Kjoerling, Solna (SE); Robin Thesing, Nuremberg (DE)

(73) Assignee: Dobly International AB, Amsterdam Zuidoost (NL)

( * ) Notice: Subject to any disclaimer, the term of this patent is extended or adjusted under 35 U.S.C. 154(b) by 1128 days.

(21) Appl. No.: 13/509,396

(22) PCT Filed: Dec. 14, 2010

(86) PCT No.: PCT/EP2010/069651

§ 371 (c)(1),
(2), (4) Date: May 11, 2012

(87) PCT Pub. No.: WO2011/073201

PCT Pub. Date: Jun. 23, 2011

(65) Prior Publication Data

US 2012/0275607 A1 Nov. 1, 2012

Related U.S. Application Data

(60) Provisional application No. 61/286,912, filed on Dec. 16, 2009.

(51) Int. Cl.

| | |
|---|---|
| ***H04S 3/02*** | (2006.01) |
| ***G10L 19/008*** | (2013.01) |
| ***G10L 21/038*** | (2013.01) |

(52) U.S. Cl.

CPC ..... *G10L 19/008* (2013.01); *G10L 21/038* (2013.01)

(58) Field of Classification Search

CPC ... G10L 19/008; G10L 21/038; G10L 25/18; G10L 19/025; H04S 2400/03

USPC ..... 381/22–23

See application file for complete search history.

(56) References Cited

U.S. PATENT DOCUMENTS

2006/0140412 A1* 6/2006 Villemoes ..... G10L 19/008 381/12

2007/0140499 A1* 6/2007 Davis ..... G10L 19/008 381/23

(Continued)

FOREIGN PATENT DOCUMENTS

| | | |
|---|---|---|
| CN | 1878001 | 12/2006 |
| CN | 1926610 | 3/2007 |

(Continued)

OTHER PUBLICATIONS

Samsudin, et al., "A Stereo to Mono Downmixing Scheme for MPEG-4 Parametric Stereo Encoder" Acoustics, Speech and Signal Processing, 2006 IEEE International Conference May 2006.

(Continued)

*Primary Examiner* — Duc Nguyen
*Assistant Examiner* — George Monikang

(57) ABSTRACT

The present document relates to audio decoding and/or audio transcoding. In particular, the present document relates to a scheme for efficiently decoding a number M of audio channels from a bitstream comprising a higher number N of audio channels. In this context a method and system for merging a first and a second source set of spectral band replication (SBR) parameters to a target set of SBR parameters is described. The first and second source set comprise a first and second frequency band partitioning, respectively, which are different from one another. The first source set comprises a first set of energy related values associated with frequency bands of the first frequency band partitioning. The second source set comprises a second set of energy related values associated with frequency bands of the second frequency band partitioning. The target set comprises a target energy related value associated with an elementary frequency band. The method comprises the steps of breaking up the first and the second frequency band partitioning into a joint grid comprising the elementary frequency band; assigning a first value of the first set of energy related values to the elementary frequency band; assigning a second value of the second set of energy related values to the elementary frequency band; and combining the first and second value to yield the target energy related value for the elementary frequency band.

18 Claims, 7 Drawing Sheets

(56) References Cited

U.S. PATENT DOCUMENTS

| | | | | |
|---|---|---|---|---|
| 2008/0049943 | A1* | 2/2008 | Faller | G10L 19/008 381/17 |
| 2008/0221907 | A1 | 9/2008 | Pang | |
| 2009/0192792 | A1 | 7/2009 | Lee | |
| 2009/0226010 | A1 | 9/2009 | Schnell | |

FOREIGN PATENT DOCUMENTS

| | | |
|---|---|---|
| CN | 1969317 | 5/2007 |
| CN | 101484936 | 7/2009 |
| CN | 101540171 | 9/2009 |
| EP | 2057625 | 5/2009 |
| KR | 2007-0043651 | 4/2007 |
| KR | 1969317 | 5/2007 |
| RU | 2010112889 | 1/2011 |
| WO | 2005/001813 | 1/2005 |
| WO | 2007007263 | 1/2007 |

OTHER PUBLICATIONS

Neuendorf, M., et al. "A Novel Scheme for Low Bitrate Unified Speech and Audio Coding" MPEG RMO AES Convention May 2009, AES, New York, USA.

Neuendorf, M., et al. "Unified Speech and Audio Coding Scheme for High Quality at Low Bitrates" Acoustics, Speech and Signal Processing, 2009, IEEE International Conference on IEEE, Piscataway, NJ, USA Apr. 2009, pp. 1-4.

ETSI TS 126 402, Digital Cellular Telecommunications System, v8.0.0 (Jan. 2009) Technical Specification.

Chen, Qian "The Design and Realization of HE-AACv2 Decoding based on SH-Mobil" Chinese Outstanding Master's Dissertations Full Text Information Science and Technology Series, Sep. 15, 2008.

* cited by examiner

SBR BITSTREAM PARAMETER DOWNMIX

TECHNICAL FIELD

The present document relates to audio decoding and/or audio transcoding. In particular, the present document relates to a scheme for efficiently decoding a number M of audio channels from a bitstream comprising a higher number N of audio channels.

BACKGROUND OF THE INVENTION

An audio decoder conforming to the High-Efficiency Advanced Audio Coding (HE-AAC) standard is typically designed to decode and output up to N channels of audio data which are to be reproduced by individual speakers at predefined positions. A HE-AAC encoded bitstream typically comprises data relating to N low band signals corresponding to the N audio channels, as well as encoded SBR (Spectral Band Replication) parameters for the reconstruction of N high band signals corresponding to the respective low band signals.

In certain situations it may be desirable for an HE-AAC decoder to reduce the number of output channels to M channels (M being smaller than N) while preserving audio events from all N channels. One exemplary use case of such channel reduction is a mobile device which can play back N channels when connected to a multi-channel home theater system but which is limited to its built-in mono or stereo output when used standalone.

A possible way of producing M output or target channels from N input or source channels is a time domain downmix of the decoded N-channel signal. In such systems, the encoded bitstream representing the N channels is first decoded to yield N time domain audio signals which are subsequently downmixed in the time-domain to M audio signals corresponding to M channels. The downside of this approach is the amount of computational and memory resources needed for first decoding all N audio signals corresponding to N channels, and subsequently downmixing the N decoded audio signals to M downmixed audio signals.

The ETSI technical specification (TS) 126 402 (3GPP TS 26.402) describes in section 6 a method called "SBR stereo parameter to mono parameter downmix". This document is incorporated by reference. The ETSI technical specification describes an SBR parameter merging process to derive a mono SBR channel from an SBR channel pair. The specified method is, however, limited to a stereo to mono downmix where the channels are represented as a channel pair element (CPE).

In view of the above there is a need for a low complexity downmixing scheme from an arbitrary number N of channels to an arbitrary number M of channels. In particular, there is a need for a downmixing scheme for the SBR parameters associated with the N channels to SBR parameters associated with the M channels, wherein the downmixing scheme preserves the relevant high frequency information of the different channels.

SUMMARY OF THE INVENTION

In the present document methods and systems are described which provide an efficient way to reduce the number of output or target channels in an HE-AAC decoder while preserving audio events from all input or source channels. The methods and systems allow for channel downmixing from an arbitrary number N of channels to an arbitrary number M of channels, where M is smaller than N. The methods and systems can be implemented at reduced computational complexity compared to downmixing in the time-domain. It should be noted that the described methods and systems are applicable to any multichannel decoder that uses SBR for high frequency regeneration. In particular, the described methods and systems are not limited to HE-AAC encoded bitstreams. Furthermore, it should be noted that the following aspects are outlined for the merging of a first and a second source channel to a target channel. These terms are to be understood as "at least a first" and "at least a second" and "at least a target" channel and therefore apply to the merging of an arbitrary number N of source channels to an arbitrary number M of target channels.

According to an aspect, a method for merging a first and a second source set of spectral band replication (SBR) parameters to a target set of SBR parameters is described. The source set of SBR parameters may correspond to SBR parameters associated with an audio channel of an HE-AAC bitstream. A source set and/or a target set of SBR parameters may correspond to SBR parameters of a frame of an audio signal of the particular audio channel. As such, the first source set may correspond to a first audio signal of a first audio channel, the second source set may correspond to a second audio signal of a second audio channel and the target set may correspond to a target audio signal of a target channel. A source set and/or a target set may comprise data which is used to generate a high frequency component of the respective audio signal from a low frequency component of the respective audio signal. In particular, a set of SBR parameters may comprise information regarding the spectral envelope of the high frequency component within a predefined time interval of a frame of the respective audio signal. The spectral information comprised within such time interval is typically referred to as an envelope.

The first and second source sets, and in particular envelopes of the first and second source sets, may comprise a first and second frequency band partitioning, respectively. These first and second frequency band partitioning may be different from one another. The first source set may comprise a first set of energy related values associated with frequency bands of the first frequency band partitioning; and the second source set may comprise a second set of energy related values associated with frequency bands of the second frequency band partitioning. The target set may comprise a target energy related value associated with an elementary frequency band.

Such energy related values may be scale factor energies and the frequency bands may be scale factor bands. Alternatively or in addition, the energy related values may be noise floor scale factor energies and the frequency bands may be noise floor scale factor bands.

The method may comprise the step of breaking up the first and the second frequency band partitioning into a joint grid comprising the elementary frequency band. The first and second frequency band partitioning may span a frequency range of the high frequency component of the respective audio signal. This frequency range may be subdivided into the joint frequency grid. The joint grid may be associated with a quadrature mirror filter bank (QMF filter bank) which is used to determine the SBR parameters. In particular, a QMF filter bank may be used at the analysis stage to determine a spectral segmentation of the high frequency component of the respective audio signal into QMF subbands. Such a QMF subband may be an elementary frequency band of the joint frequency grid.

It should be noted that the first frequency band partitioning may span a different frequency range than the second frequency band partitioning. In particular, the start frequency of the first frequency band partitioning, i.e. the lower bound of the first frequency band partitioning, may be different from the start frequency of the second frequency band partitioning, i.e. the lower bound of the second frequency band partitioning. Typically, the joint frequency grid covers the overlapping frequency range of the first and the second frequency band partitioning. In particular, frequency bands or one or more portions of a frequency band which are below the higher one of the start frequencies may not be considered.

The method may comprise assigning a first value of the first set of energy related values to the elementary frequency band; and/or assigning a second value of the second set of energy related values to the elementary frequency band. The first assigning step may be performed such that the first value corresponds to the energy related value associated with a frequency band of the first frequency band partitioning which comprises the elementary frequency band. The second assigning step may be performed such that the second value corresponds to the energy related value associated with a frequency band of the second frequency band partitioning which comprises the elementary frequency band.

The method may comprise the step of combining, e.g. adding and/or scaling, the first and second value to yield the target energy related value for the elementary frequency band. Furthermore, the target energy related value may be normalized by the number of contributing source sets. By way of example, the target energy related value may be divided by the number of contributing source sets in order to determine an average value of the contributing energy related values of the source sets.

The above method has been specified for a particular elementary frequency band. The method may comprise the additional step of repeating the assigning steps and the combining step for all elementary frequency bands of the joint grid and to thereby yield a set of target energy related values of the target set.

The target set may comprise a target frequency band partitioning with a predefined target frequency band. Typically such a target frequency band has a single associated target energy related value. For the determination of this associated target energy related value, the method may comprise the step of averaging the set of target energy related values associated with the elementary frequency bands comprised within the target frequency hand. The averaged value may be assigned as the target energy related value of the target frequency band.

The first source set may be associated with a first signal of a first source channel; and/or the second source set may be associated with a second signal of a second source channel; and/or the target set may be associated with a target signal of a target channel. Typically, the source sets and the target set are associated with a certain time interval of the corresponding signal. Such time intervals may be defined by so-called envelopes.

In particular, the target energy related value of the target set may be associated with a target time interval of the target signal; and/or the first set of energy related values of the first source set may be associated with a first time interval of the first signal, wherein the first time interval may overlap the target time interval. In such cases, the above mentioned combining step may comprise the step of scaling the first value of the first set of energy related values in accordance to a ratio given by the length of the overlap of the first time interval and the target time interval, and the length of the target time interval. As a consequence, the scaled first value and the second value may be combined, e.g. added, to yield the target energy related value.

Furthermore, the first source set may comprise a third frequency band partitioning; and/or the first source set may comprise a third set of energy related values associated with frequency bands of the third frequency band partitioning; and/or the third set of energy related values may be associated with a third time interval of the first low band signal, wherein the third time interval may overlap the target time interval. It should be noted that the third frequency band partitioning may correspond to, in particular it may be equal to, the first frequency band partitioning. In such cases, the method may further comprise the step of breaking up the third frequency band partitioning into the joint grid comprising the elementary frequency band; and/or assigning a third value of the third set of energy related values to the elementary frequency band. In such cases, the above mentioned combining step may comprise the step of scaling the third value in accordance to a ratio given by the length of the overlap of the third time interval and the target time interval, and the length of the target time interval. As a consequence, the scaled first value, the second value and the scaled third value may be combined, e.g. added, to yield the target energy related value.

According to a further aspect, a method for merging a first and a second source set of SBR parameters to a target set of SBR parameters is described. The first source set may be associated with a first low band signal of a first source channel and may comprise a first set of scale factor energies. The second source set may be associated with a second low band signal of a second source channel and may comprise a second set of scale factor energies. The target set may be associated with a target low band signal of a target channel obtained from time-domain downmixing of the first and second low band signal. Furthermore, the target set may comprise a target set of scale factor energies.

The method may comprise the step of weighting a first and a second downmix coefficient by an energy compensation factor; wherein the first downmix coefficient may be associated with the first source channel; wherein the second downmix coefficient may be associated with the second source channel; and wherein the energy compensation factor may be associated with the interaction of the first and second low band signal during time-domain downmixing. Such interaction may comprise the attenuation and/or amplification of the first and second low band signal, which may be due to an in-phase or anti-phase behaviour of the first and second low band signals. In particular, the energy compensation factor may be associated with the ratio of the energy of the target low band signal and the energy of the first and second low band signal or the combined energy of the first and second low-band signal.

By way of example, in a case where N source channels are merged, with N≥2, to obtain M target channels, with M<N and M≥1, the energy compensation factor $f_{comp}$ may be given by:

$$f_{comp} = \sqrt{\frac{\sum_{chout=0}^{M-1} \sum_{n} x_{dmx}^2[chout][n]}{\sum_{chin=0}^{N-1} \sum_{n} (c_{chin} \cdot x_{in}[chin][n])^2}}$$

wherein $x_{in}$[chin][in] is a low band time domain signal in the source channel chin, $c_{chin}$ is a downmix coefficient for the source channel chin, $x_{dmx}$[chout][n] is a low band time domain signal of the target channel chout, and n=0, . . . , 1023 is a sample index of signal samples within a frame of the time domain signals. It should be noted that $f_{comp}$ may be determined based on a subset of signal samples within a frame of the time domain signals. As such, the above sums may be computed across a subset of the samples, e.g. using every P-th sample of a frame, with P being an integer, i.e. n=0, P, 2P, 3P, . . . .

The method may further comprise the steps of scaling of the first set of scale factor energies by the first weighted downmix coefficient; and/or scaling of the second set of energies by the second weighted downmix coefficient. The target set of scale factor energies may be determined from the scaled first set of scale factor energies and the scaled second set of scale factor energies. In particular, the target set of scale factor energies may be determined according to any of the methods outlined in the present document.

According to another aspect, a method for merging a first and a second source set of SBR parameters to a target set of SBR parameters is described. The first source set may comprise a first start frequency. The second source set may comprise a second start frequency. The first and second start frequency may be different and they may be associated with lower frequency bounds of a first and second high band signal associated with the first and second source sets of SBR parameters, respectively. In particular, the first and second start frequency may be associated with lower bounds of the first and second frequency band partitioning.

The method may comprise the step of comparing the first and second start frequency; and/or the step of selecting the higher or the lower of the first and the second start frequency as a start frequency of the target set. In general terms, the start frequency of the target set may be selected based on the level of the start frequencies of the contributing source sets, e.g. the first and the second source set.

The start frequency selection may be used to determine an SBR element header of the target set. The first source set may comprise a first SBR element header comprising the first start frequency. The second source set may comprise a second SBR element header comprising the second start frequency. In such a case, the method may comprise the step of selecting a SBR element header of the target set on the basis of the first or the second SBR element header in accordance to the selected start frequency of the target set. In particular, the SBR element header comprising the higher or lower start frequency may be selected as a basis for the determination of the SBR element header of the target set.

The start frequency selection may be further restricted to source sets with special properties, e.g. the start frequency selection may exclusively or preferentially consider certain source channels. In particular, the start frequency selection may privilege source sets of source channels that exhibit a relation to each other that is similar to the desired relation of the target sets of the target channels.

By way of example, if the target set is a channel pair element and at least one of the source sets comprises a channel pair element, then the SBR element header of the target set may be selected from one of the source sets which comprises a channel pair element. If the target set is a channel pair element and none of the source sets comprises a channel pair element, then the SBR element header of the source set comprising the highest or lowest start frequency may be selected as a basis for the SBR element header of the target set. If the target set is a single channel element and at least one of the source sets is a single channel element, then the SBR element header of the target set may be selected as the SBR element header of one of the source sets that comprise a single channel element. If the target set is a single channel element and all of the source sets are channel pair elements, the SBR element header of the source set comprising the highest or lowest start frequency may be used as a basis for the SBR element of the target set.

According to another aspect, a method for merging a first and a second source set of SBR parameters to a target set of SBR parameters is described. The first source set may comprise a first transient envelope index; wherein the first transient envelope index identifies a first transient envelope with a first start time border. The second source set may comprise a second transient envelope index; wherein the second transient envelope index identifies a second transient envelope with a second start time border. The target set may comprise a plurality of target envelopes, each target envelope having a start time border.

As outlined above, the envelopes, i.e. notably the first transient envelope, the second transient envelope and the plurality of target envelopes, may be associated with one or more time intervals of a corresponding audio signal, i.e. notably the first source signal, the second source signal and the target signal, respectively. In particular, the envelopes may be associated with one or more time intervals within a frame of the respective audio signal. A transient envelope index may be used to identify an envelope which comprises information on an acoustic transient.

The method may comprise the step of selecting the earlier one of the first and second start time borders; and/or the step of determining as a target transient envelope the envelope of the plurality of target envelopes for which the start time border is closest to the earlier one of the first and second start time borders; and/or the step of setting a target transient envelope index to identify the target transient envelope. In an embodiment, the method may comprise the step of determining as a target transient envelope the envelope of the plurality of target envelopes for which the start time border is closest to the earlier one of the first and second start time borders but not later than the earlier one of the first and second start time borders.

According to a further aspect, a method for merging N source sets of SBR parameters to M target sets of SBR parameters is described. N may be greater than 2 and M may be smaller than N. The method may comprise the step of merging a pair of source sets to yield an intermediate set; and/or the step of merging the intermediate set with a source set or another intermediate set to yield a target set. As such, the method may comprise subsequent merging steps and thereby provide a hierarchical method for merging N source sets of SBR parameters to M target sets of SBR parameters. The merging steps may be performed according to any of the methods and aspects outlined in the present document. In an embodiment, source sets corresponding to source channels of higher acoustic relevance are merged less often than source sets corresponding to source channels of lower acoustic relevance.

According to further aspect, a software program is described. The software program may be adapted for execution on a processor and for performing any of the method steps outlined in the present document when carried out on a computing device.

According to further aspect, a storage medium is described. The storage medium may comprise a software program adapted for execution on a processor and for performing any of the method steps outlined in the present document when carried out on a computing device.

According to another aspect, a computer program product is described. The computer program may comprise executable instructions for performing any of the method steps outlined in the present document when executed on a computer.

According to another aspect, an SBR parameter merging unit is described. The SBR merging unit may be configured to provide M target sets of SBR parameters from N source sets of SBR parameters, wherein N>M≥1. The SBR parameter merging unit may comprise a processor configured to perform any of the aspects and the method steps outlined in the present document.

According to a further aspect, an audio decoder configured to decode an HE-AAC bitstream comprising N audio channels is described. The audio decoder may comprise an AAC decoder configured to receive the encoded HE-AAC bitstream and to provide a separate SBR bitstream; and/or an SBR decoder configured to provide N source sets of SBR parameters corresponding to the N audio channels from the SBR bitstream; and/or an SBR parameter merging unit, as outlined above, configured to provided M target sets of SBR parameters from the N source sets of SBR parameters, wherein N>M≥1.

The AAC decoder may be configured to provide N time domain low band audio signals corresponding to the N audio channels. The audio decoder may comprise a time domain downmix unit configured to provide M time domain low band audio signals from the N time domain low band audio signals; and/or an SBR unit configured to generate M high band audio signals from the M low band audio signals and the M target sets of SBR parameters. Thereby, the audio decoder may be configured to provide M audio signals comprising the M low band audio signals and the M high band audio signals, respectively.

According to a further aspect, an audio transcoder configured to provide an HE-AAC bitstream comprising M audio channels from an HE-AAC bitstream comprising N audio channels, wherein N>M≥1, is described. The audio transcoder may comprise a SBR parameter merging unit as outlined above.

According to another aspect, an electronic device configured to render M audio signals corresponding to M channels from an HE-AAC bitstream comprising N audio channels, wherein N>M≥1, is described. The electronic device may e.g. be a media player, a settop box or a smartphone. The electronic device may comprise audio rendering means configured to perform the acoustic rendering of the M audio signals; and/or a receiver configured to receive the encoded HE-AAC bitstream; and/or an audio decoder configured to provide the M audio signals from the HE-AAC bitstream according to any of the aspects outlined in the present document.

It should be noted that the embodiments and aspects described in this document may be arbitrarily combined. In particular, it should be noted that the aspects and features outlined in the context of a system are also applicable in the context of the corresponding method and vice versa. Furthermore, it should be noted that the disclosure of the present document also covers other claim combinations than the claim combinations which are explicitly given by the back references in the dependent claims, i.e., the claims and their technical features can be combined in any order and any formation.

BRIEF DESCRIPTION OF THE DRAWINGS

The present invention will now be described by way of illustrative examples, not limiting the scope or spirit of the invention, with reference to the accompanying drawings, in which.

DETAILED DESCRIPTION

A HE-AAC decoder may be divided into an AAC core decoder that decodes the low band of the encoded audio signal, and a spectral band replication (SBR) algorithm that regenerates the high band of the audio signal using the decoded low band signal and parametric information conveyed in the bitstream. Typically, the SBR algorithm requires more computational resources than the AAC core decoder. This is due to the filter banks used at the analysis and synthesis stages of the high frequency reconstruction, i.e. the spectral band replication. By way of example, in a typical embodiment, the computational resources required for AAC decoding are about ⅓, wherein the computational resources required for decoding of the SBR parameters and for performing the high frequency reconstruction are about ⅔ of the overall computational resources required for decoding of an HE-AAC bitstream.

A decoder may receive an HE-AAC bitstream representing an N channel audio signal. However, due to various reasons, e.g. limitations of the audio rendering device, the decoder may need to provide an output signal which comprises only M audio channels (with M smaller than N). In an alternative usage scenario, a transcoder may receive an input HE-AAC bitstream representing an N channel audio signal and may provide an output HE-AAC bitstream representing an M channel audio signal.

In view of the high computational complexity of the reconstruction of the high frequency component or the high band of the audio signal using the SBR parameters, it may be beneficial to perform the downmix from N to M channels in the encoded domain, prior to an optional decoding of the downmixed bitstream and a generation of M high band audio signals corresponding to the M channels. In the following, a method will be described which allows for an efficient merging of the SBR parameters of N input or source channels to SBR parameters of M output or target channels. The merging of the SBR parameters is performed such that the information regarding specific audio events is preserved.

The proposed method may comprise the step of decoding of the SBR parameters for the N input channels thereby providing N sets of SBR parameters corresponding to the N source channels. Subsequently, the step of merging of the SBR parameters is performed to obtain M sets of SBR parameters corresponding to the M target channels. For the provision of an M channel output signal, the method may comprise the step of decoding of the AAC-coded low band signal for all N input channels with a subsequent time domain downmix to obtain M output channels. Furthermore, the spectral band reconstruction for M channels may be performed using the M downmix channels obtained from the AAC-coded low band signal and the corresponding new set of SBR parameters obtained in the above SBR merging step.

Figure 1:
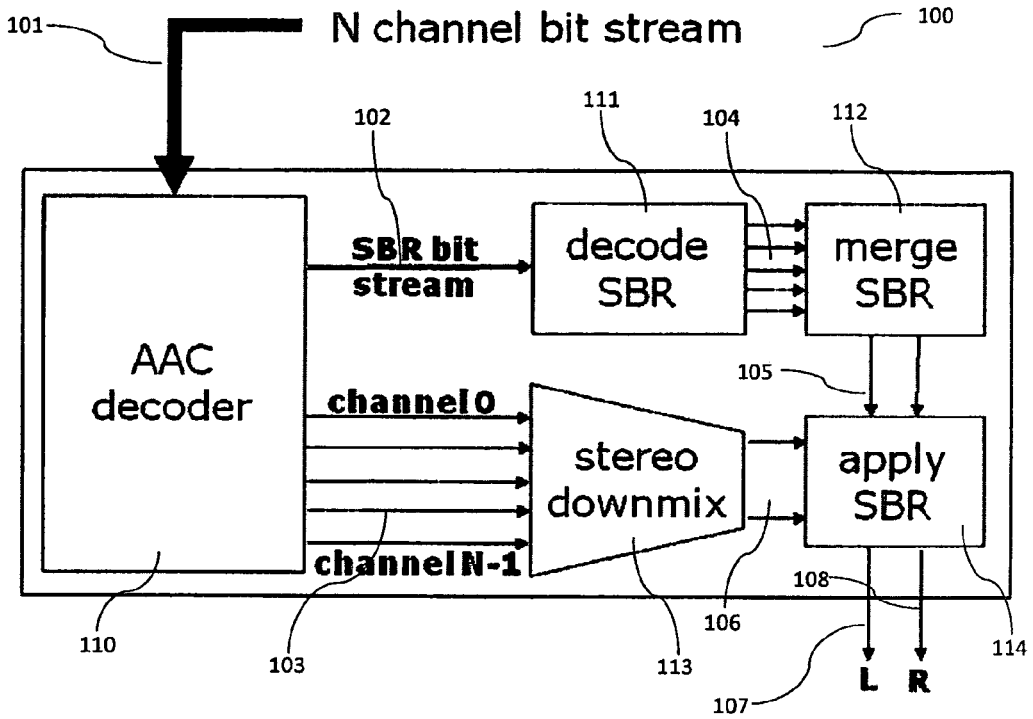
FIG. 1 illustrates an exemplary block diagram of a downmix system for an N channel HE-AAC bitstream to a stereo audio signal.

An exemplary HE-AAC decoder 100 providing two output audio signals 107, 108 corresponding to two output or target channels from an input HE-AAC bitstream 101 representing N audio channels is shown in FIG. 1. An AAC decoder 110 performs the decoding of the HE-AAC bitstream 101 into N audio signals 103 comprising the low frequency components of the N audio signals, also referred to as the low band audio signals 103. The N low band audio signals 103 are downmixed to two low band audio signals 106 within a time domain downmix unit 113. The AAC decoder further provides the SBR bitstream 102 comprising the SBR parameters for the N audio channels. The SBR bitstream 102 is decoded within an SBR decoder 111 to yield N sets of SBR parameters 104, one set of SBR parameters 104 for each of the N audio channels. The parameter extraction and decoding may be performed in accordance to ISO/IEC 14496-3 subparts 4.4.2.8 and 4.5.2.8 which are incorporated by reference. The N sets of SBR parameters 104 are merged to two sets of SBR parameters 105 in the SBR parameter merging unit 112. Eventually, the spectral band replication or the high frequency reconstruction of the two output audio signals 107, 108 is performed in the SBR unit 114. The SBR unit 114 generates the high frequency components of the two audio signals using the low band audio signals 106 and the sets of merged SBR parameters 105, and provides as an output two audio signals 107, 108 which comprise the respective low and high frequency components.

Figure 2:
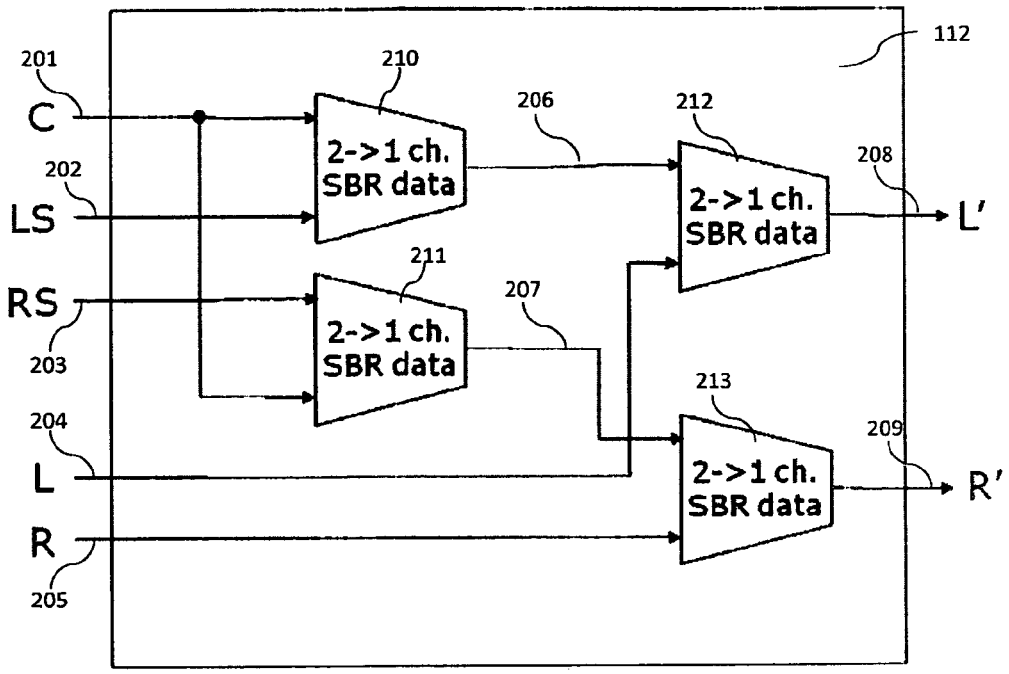
FIG. 2 illustrates an exemplary block diagram of an SBR parameter merging unit having five input channels and two output channels.

FIG. 2 illustrates a block diagram of an exemplary SBR parameter merging unit 112. The illustrated SBR parameter merging unit 112 has a hierarchical structure for merging the five sets of SBR parameters 201, 202, 203, 204, 205 at the input to two sets of SBR parameters 208, 209 at the output. The SBR parameter merging unit 112 comprises "two-to-one" SBR parameter merging units 210, 211, 212, 213 which merge two sets of SBR parameters 201, 202 at the input to one set of SBR parameters 206 at the output. The "two-to-one" SBR parameter merging units 210, 211, 212, 213 will be referred to as "elementary merging units". Through the use of hierarchically organized elementary merging units 210, it is possible to provide a flexible and adaptive SBR parameter merging unit 112, which is operable to merge an arbitrary number N of SBR parameter sets 201 at the input to an arbitrary number M of SBR parameter sets 208 at the output. By adding or removing elementary merging units 210, the overall SBR parameter merging unit 112 can be adapted to a changing number N of input channels and/or a changing number M of output channels.

FIG. 2 illustrates the example of an SBR parameter merging unit 112 which merges the SBR parameters of a 5.1 input signal to SBR parameters of a stereo output signal. A 5.1 signal comprises 5 full-range channels, referred to as the left (L), the right (R), the surround left (LS), the surround right (RS) and the centre (C) channel, as well as a low frequency effects (LFE) channel. In the illustrated example, the LFE channel has not been considered. Typically, the content of such LFE channel is only preserved if an LFE channel is also available as one of the output channels.

In the illustrated embodiment, the set of SBR parameters 201 corresponding to the C channel is merged in a first elementary merging unit 210 with the set of SBR parameters 202 of the LS channel, and in a second elementary merging unit 211 with the set of SBR parameters 203 of the RS channel. This yields two sets of merged SBR parameters 206, 207, respectively. These sets of merged SBR parameters 206, 207 may be referred to as intermediate sets of SBR parameters.

Subsequently, the set of merged SBR parameters 206 is merged with the set of SBR parameters 204 of the L channel in the elementary merging unit 212 to yield the set of merged SBR parameters 208 corresponding to the left channel (L') of the stereo output signal. The set of merged SBR parameters 207 is merged with the set of SBR parameters 205 of the R channel in the elementary merging unit 213 to yield the set of merged SBR parameters 209 corresponding to the right channel (R') of the stereo output signal.

The illustrated hierarchical merging scheme is only one possibility for merging the plurality of sets of SBR parameters at the input. The sets of SBR parameters could also be merged in a different order. It should be noted, however, that typically each merging step within an elementary merging unit 210 leads to a dilution of the information comprised within the sets of SBR parameters. Consequently, it may be preferable to submit channels of higher acoustic importance or higher acoustic relevance to a lower number of merging steps than channels of relatively lower acoustic importance or acoustic relevance. By way of example, the L and R channels may be submitted to less merging steps than the C channel. As a further example, in the case of a motion picture soundtrack in which the C channel conveys dialogue which is of high acoustic importance, the C channel may be submitted to fewer merging steps than the L and R channels.

In an alternative embodiment, the SBR parameter merging unit 112 may be implemented as an overall matrix, directly merging N sets of SBR parameters 201 at the input to M sets of SBR parameters 208 at the output.

In the following, the merging of two sets of SBR parameters 201, 202 to one set of merged SBR parameters 206 in an elementary merging unit 210 will be described. The described methods and systems could be generalized by considering more than two sets of SBR parameters at the input.

Figure 3:
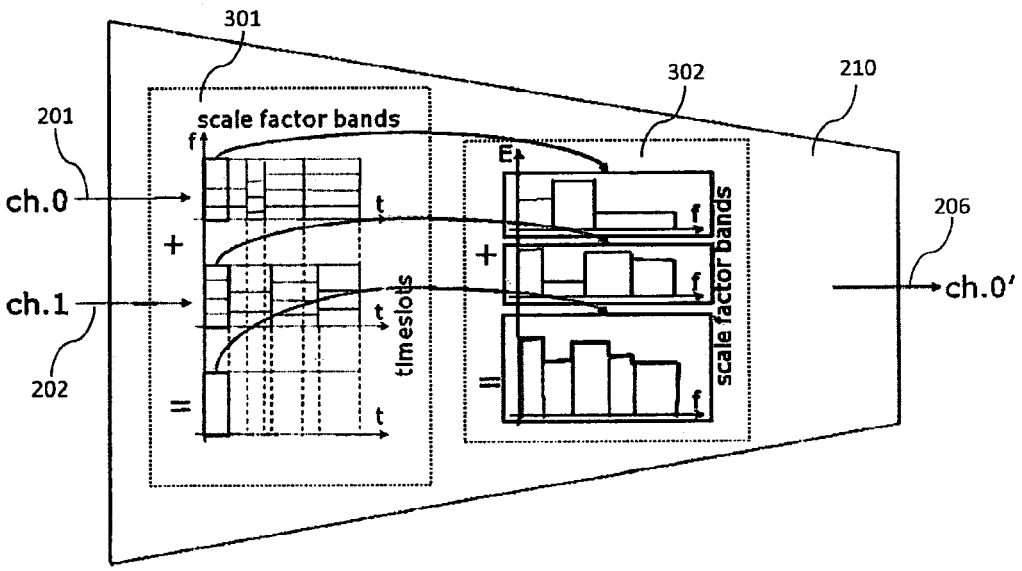
FIG. 3 shows an exemplary block diagram of an SBR parameter merging unit having two input channels and one output channel.

In FIG. 3, a block diagram of an exemplary elementary merging unit 210 is shown. The elementary merging unit 210 provides a set of merged SBR parameters 206, also referred to as the target set, from two sets of SBR parameters 201, 202, also referred to as the source sets. The illustrated elementary merging unit 210 typically performs the merging of SBR parameters on a frame by frame basis, i.e. the SBR parameters of a frame of the input signals corresponding to respective input channels are merged in order to provide the SBR parameters of a corresponding frame of the output signal of an output channel. For ease of illustration, the set of SBR parameters 201, 202, 206 refer to sets of SBR parameters of a single frame in the following.

By way of example, a frame of the input signal may comprise a set of envelopes covering a nominal length of 2048 samples at the output signal sample rate. If, for example, the QMF filterbank has a frequency resolution of 64 subbands, the frame-length of 2048 would correspond to 32 QMF subband samples in every subband. Furthermore, an additional unit may be introduced, e.g. a "time-slot", that combines subband samples on a two-subband-samples granularity. In other words, a frame may comprise 32 QMF subband samples (per QMF subband) corresponding to 16 time-slots.

The illustrated elementary merging unit 210 comprises an envelope time border determination unit 301 which determines the envelope time borders of the target set 206 from the envelope time borders of the two source sets 201, 202. The envelope time border determination unit 301 is described in further detail in relation to FIG. 4. Subsequently, the scale factor energies of the target set 206 are determined from the scale factor energies of the source sets 201, 202 in a scale factor energies determination unit 302. The scale factor energies determination unit 302 is outlined in further detail in relation to FIGS. 5*a*, 5*b*, 5*c* and 5*d*.

In addition to the merging of envelope time border parameters and scale factor energies, the SBR parameter merging unit 112 or the elementary merging unit 210 may perform the merging of further SBR parameters. The SBR parameter "Inverse filtering levels" may be merged according to ETSI TS 126 402, section 6.1 which is incorporated by reference. The SBR parameter "additional harmonics" may be merged according to ETSI TS 126 402, section 6.2, which is incorporated by reference.

Furthermore, the SBR parameter "frequency resolution per envelope" may be required. This parameter comprises the parameter bs_freq_res which is a binary switch to select one of two frequency tables. The value bs_freq_res=0 selects a low resolution table, whereas bs_freq_res=1 selects a high resolution table. Both tables are typically derived from a master frequency table by selecting a subset of frequency bands. The frequency resolution of the master frequency table is determined by the parameter bs_freq_scale. The value bs_freq_scale=0 is the finest resolution with one QMF subband per frequency band. Higher values of the parameter bs_freq_scale result in coarser resolutions of 8-12 frequency bands per octave. Details on this SBR parameter can be found in ISO/IEC 14496-3 subpart 4.6.18.3.2 which is incorporated by reference. Typically, the parameter bs_freq_scale is comprised within the SBR element header. The merging of the SBR element header is dealt with below. The parameter bs_freq_res may be set to 1 for the merged channel, thereby indicating that the tables with fine resolution are to be used.

The parameter "SBR element headers" may be merged according to the following process 1) The start/stop frequencies of all source channel elements may be determined. In case of the SBR parameter merging unit 112, the possible source channels are the channels 201, 202, 203, 204, 205.
2) The header of the source channel element with the highest start frequency is chosen as the header for the target channel element that it is part of. In case of the target channel element 208, the headers of the source channel elements 201, 202 and 204 are considered. In case of the target channel element 209, the headers of the source channel elements 201, 203 and 205 are considered. It should be noted that in alternative embodiments, it may be beneficial to select the header of the source channel element with the lowest start frequency as the header for the target channel element that it is part of.
3) The target channel header selection may be further restricted to match the channel element type of the target channel element.

If a target channel element is a CPE (channel pair element), the header of the source CPE with the highest start frequency that is part of the mix is chosen as the header for the target channel element. If no source CPE is present, the header of the source SCE (single channel element) with the highest start frequency is chosen and used to construct a CPE header for the target channel element.

If the target channel element is a SCE, the header of the source SCE with the highest start frequency that is part of the mix is chosen as the header for the target channel element. If no source SCE is present, the header of the source CPE with the highest start frequency is chosen and used to construct a SCE header for the target channel element.

It should be noted that typically the start and stop frequencies of the first and second source sets 201, 202 are different. The start/stop frequencies are typically defined within the SBR element header of the respective source set 201, 202. The start frequency of an audio channel, also referred to as the cross-over frequency, specifies the maximum frequency of the low frequency component and/or the minimum frequency of the high frequency component. When merging a certain number of audio channels, it may be beneficial to ensure that the merged high frequency component does not interfere with the merged low frequency component. The reason for this lies in the fact that the AAC encoded low frequency component typically comprises more relevant acoustic information than the SBR encoded high frequency component. Consequently, the interference of a low frequency signal component with a high frequency signal component derived from merged SBR parameters should be avoided. This can be ensured by selecting a start frequency of the target set 206 or target channel which is the maximum start frequency of the source sets 201, 202 which contribute to the target set 206. In particular, the above mentioned risk of interference between the merged low frequency component and the merged high frequency component can be avoided by selecting an SBR element header of the target set 206 as outlined above.

In the following, the merging of SBR parameters which are related to time borders is outlined. It should be noted that even though the following description is related to the merging of envelope time borders, it may also be applied to noise envelope time borders. In addition, reference is made to ETSI TS 126 402, section 6.4, which is incorporated by reference, where a scheme for merging noise envelope time borders is described.

HE-AAC allows for the definition of up to five envelopes within a frame. These envelopes specify the spectral envelope of the high frequency component of the encoded audio signal within a specific time interval of the frame. The time borders of the different envelopes can be defined along the time axis according to a certain time grid. Typically the length of a frame, e.g. 24 ms, is sub-divided into a number of time slots (e.g. 16 time slots), each defining a possible time border for an envelope. The envelope time borders of the source sets 201, 202 may be merged according to ETSI TS 126 402, section 6.3, which is incorporated by reference.

Figure 4:
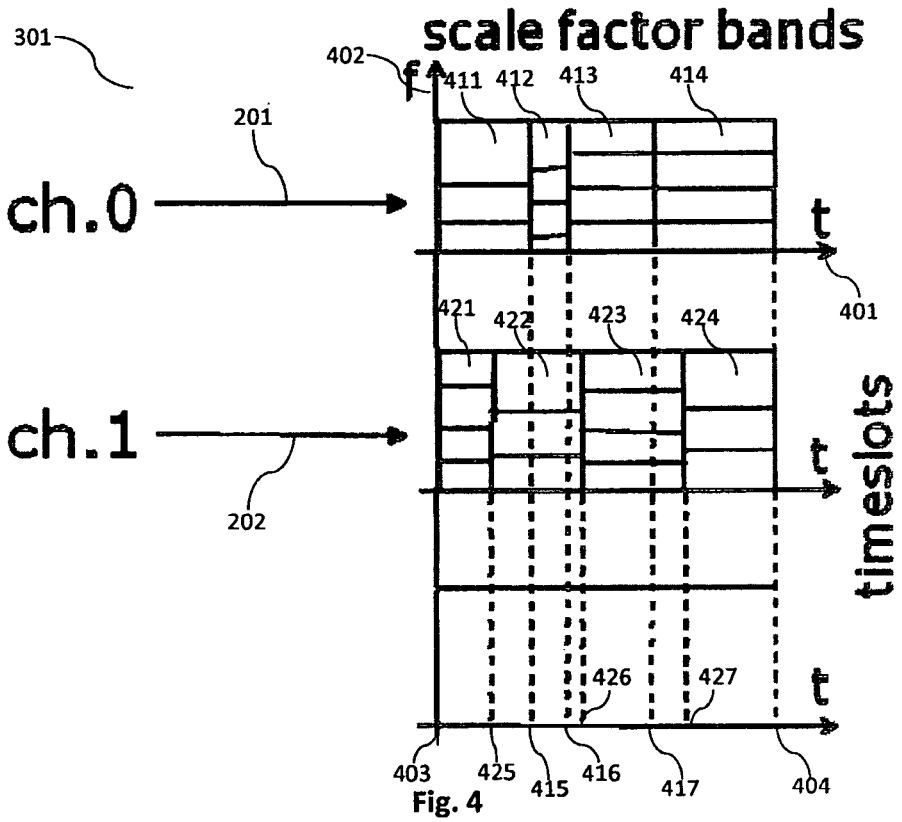
FIG. 4 illustrates the exemplary merging of envelope time borders performed within the SBR parameter merging unit of FIG. 3.

FIG. 4 illustrates the spectral envelopes defined by the two source sets 201, 202. The spectral envelopes are represented as tiles on a time/frequency diagram, wherein the time t 401 represents the length of a frame and the frequency f 402 represents the frequencies of the high frequency component of the respective audio signal. The source set 201 in the illustrated example specifies four envelopes 411, 412, 413, 414 with intermediate time borders 415, 416, 417. The source set 202 in the illustrated example specifies four envelopes 421, 422, 423, 424 with intermediate time borders 425, 426, 427. The intermediate time borders are start time borders for a following envelope and stop time borders of a preceding envelope. In addition, FIG. 4 shows the start time border 403 of the first envelope and the stop time border 404 of the last envelope.

The envelope time border determination unit 301 is operable to provide a time structure, i.e. the start time borders and the stop time borders, of the envelopes of the target set 206 from the time structure of the envelopes 411, 412, 413, 414, 421, 422, 423, 424 of the source sets 201, 202. For this purpose the time structure, i.e. the start time borders and the stop time borders, of the source sets 201, 202 are overlaid as depicted in FIG. 4. As a result of this overlay of the envelopes of the two source sets 201, 202, a time structure comprising seven time intervals for the target set 206 are obtained, wherein these time intervals are defined by the time borders [403, 425], [425, 415], [415, 416], [416, 426], [426, 417], [417, 427] and [427, 404]. These time intervals may be understood as the time intervals of respective envelopes of the target set 206. If the number of obtained time intervals of the target set 206 does not exceed a maximum number of allowed envelopes, the obtained time borders could be maintained. The maximum number of allowed envelopes may be imposed by the underlying encoding scheme. In the case of HE-AAC, the maximum number of allowed envelopes per frame is fixed to five.

However, if the number of allowed time intervals is exceeded, then a certain number of time intervals of the target set 206 need to be merged. This could be done by merging all time intervals smaller than two time slots with the directly preceding or succeeding time interval. This could be achieved by starting from the beginning of the time axis 401, indicated by the start time border 403, and remove all stop time borders that are closer than 2 from a corresponding start time border. In the illustrated example, the stop time border 426 would be removed, thereby creating a new time interval with the time borders [416,417]. If after such operation, there are still more time intervals than the allowed maximum number of envelopes (e.g. five), the number of time intervals may be further reduced. This could be achieved by starting from the end of time axis 401, indicated by the stop time border 404, and searching towards the beginning of the time axis 401, indicated by reference sign 403, for a time interval which is smaller than 4 time slots and remove the start time border of that time interval. This search operation may continue until a number of time intervals is reached which corresponds to the maximum number of allowed envelopes. In the illustrated example, the start time border 417 would be removed, thereby creating a new time interval with the time borders [416,427].

By using the above process of merging time intervals, it can be ensured that the number of time intervals of the target set 206 does not exceed the maximum number of allowed envelopes. In the above example, the number of time slots is 16 and the maximum number of allowed envelopes is 5. The average time interval of the envelopes of the target set 206 should be no less than 16/5=3.2 time slots, which can be achieved by merging time intervals with a progressively increasing threshold (as described above). In general, it may be stated that the average length of the time intervals should be at least the ratio of the number of time slots per frame and the maximum number of allowed envelopes.

As an output of the envelope time border determination unit 301, the time intervals, which are defined by the time borders 403, 425, 415, 416, 427, 404, of the spectral envelopes of the target set 206 are obtained. The number of time borders has been reduced such that the number of time intervals does not exceed a maximum allowed number of spectral envelopes.

The above process of determining the time intervals of the envelopes of the target set 206 may be generalized to an arbitrary number of source sets 201. In such case, all the time borders of the source sets 201 would be overlaid as shown in FIG. 4 and as outlined above. Using a subsequent merging process of the time intervals, a predetermined number of time intervals of the envelopes of the target set 206 could be determined.

It should be noted that an envelope of a frame may be marked as a transient spectral envelope, thereby indicating the presence of a transient in the audio signal in a specific time interval within the frame. Typically, the number of transient spectral envelopes per frame and per channel is limited to one. The transient spectral envelope is usually marked by an index $l_A$ indicating the number of the spectral envelope. If the maximum number of allowed spectral envelopes is 5, the index $l_A$ could e.g. take on any of the values 0, . . . , 4. The transient envelope index of the source sets may be merged as follows:

i. For each source set 201, 202 it is determined if the transient envelope index $l_A$ of the current frame indicates that a transient is present, i.e. $l_A \neq -1$.
ii. For each $l_A \neq -1$ the start time border of that envelope is determined.
iii. If there are transients present in the different source sets 201, 202 and hence multiple start time borders have been determined, the smallest start time border (i.e. the earliest one) may be chosen.
iv. Within the target set 206 the time border is identified which is closest to the start time border that has been determined in steps i-iii.
v. The time interval or envelope of the target set 206, for which the start time border corresponds to the border identified in step iv, is chosen as the transient envelope $l_A$ of the merged channel.

If it is assumed in the example illustrated in FIG. 4 that the source set 201 comprises a transient envelope 414 and the source set 202 comprises a transient envelope 423, then step iii selects the start time border 426. Subsequently, in step iv the start time border 416 of the target set 206 which is closest to the start time border 426 is determined and the time interval [416,427] is marked as the transient envelope by setting the transient envelope index $l_A$ to 2. By applying the above method, a transient tends to be moved to an earlier of the possible time intervals. This may have psychoacoustic advantages over selecting a later start time border, e.g. due to temporal masking effects of the earlier transient. Furthermore, the above method typically ensures that the transient envelope of the target set 206 covers many of the time slots of the transient envelopes 414, 423 of the source sets 201, 203. It should be noted, however, that as a further or alternative restriction, the transient envelope of the target set 206 may be selected such that its start time border is not later than any of the start time borders of the transient envelopes 414, 423 of the source sets 201, 202.

The above process for determining the transient envelope index of the target set 206 from one or more transient envelope indexes of the source sets 201, 202 may be generalized to an arbitrary number of transient envelope indexes of an arbitrary number of source sets. For this purpose, the method steps ii, iii, iv and v are executed for the arbitrary number of transient envelope indexes.

In the following, the merging of the spectral envelopes of the two source sets 201, 202 within the scale factor energies determination unit 302 is described. A spectral envelope comprises one or more scale factor bands and a scale factor for each of the scale factor bands. In other words, a spectral envelope specifies the spectral energy distribution of the high band signal of a respective channel within the time interval of the spectral envelope.

As outlined above, the time intervals of the spectral envelopes of the target set 206 have been determined in the envelope time border determination unit 301. The scale factor energies determination unit 302 is operable to determine the scale factor bands and the associated scale factors of the spectral envelopes of the target set 206 from the spectral envelopes of the source sets 201, 202.

Figure 5A:
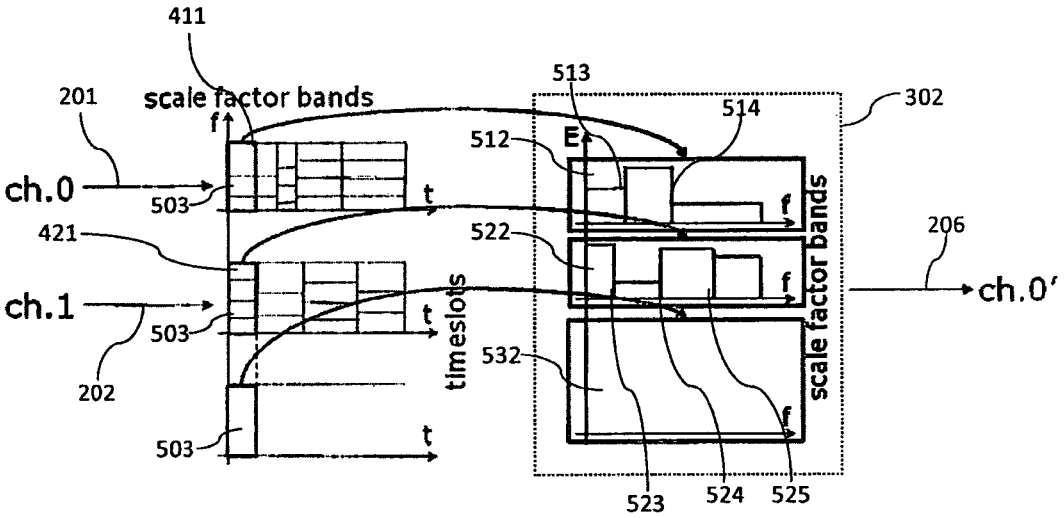
FIGS. 5*a, b, c* and *d* illustrate an exemplary process for the determination of the scale factor energies of a target channel from two source channels.

FIG. 5*a* illustrates the underlying principle for the merge of the scale factor energies comprised within the spectral envelopes of the two source sets 201, 202. In the envelope time border determination unit 301, the time borders 403, 425 of an envelope 532 of the target set 206 have been determined. This envelope 532 spans the time interval 503 defined by the respective time borders 403, 425. The time interval 503 is applied to the spectral envelopes of the source sets 201, 202, thereby specifying the spectral envelopes of the source sets 201, 202 which contribute to the spectral envelope 532 of the target set. In the illustrated example, it can be seen that the spectral envelope 411 of source set 201 falls within the time interval 503 and therefore contributes to the spectral envelope 532 of the target set 206. Furthermore, it can be seen that the spectral envelope 421 of source set 202 falls within the time interval 503 and therefore contributes to the spectral envelope 532 of the target set 206.

It should be noted that in general, one or more spectral envelopes 411 of a source set 201 may fall within the time interval 503 of the spectral envelope 532 of the target set 206. Consequently, more than one spectral envelope 411 of a source set 201 may contribute to the spectral envelope 532 of the target set 206. This aspect of multiple contributing spectral envelopes will be outlined at a later stage. For ease of illustration, the merging of two spectral envelopes of the source sets 201, 202 will be described at a first stage. These spectral envelopes are referred to as the first source envelope 512 and the second source envelope 522 and are associated with the spectral envelopes 411, 421 of the source sets 201, 202, respectively. In an embodiment, the first and second source envelopes 512, 522 may correspond to the spectral envelopes 411, 421 of the source sets 201, 202, respectively.

Figure 5B:
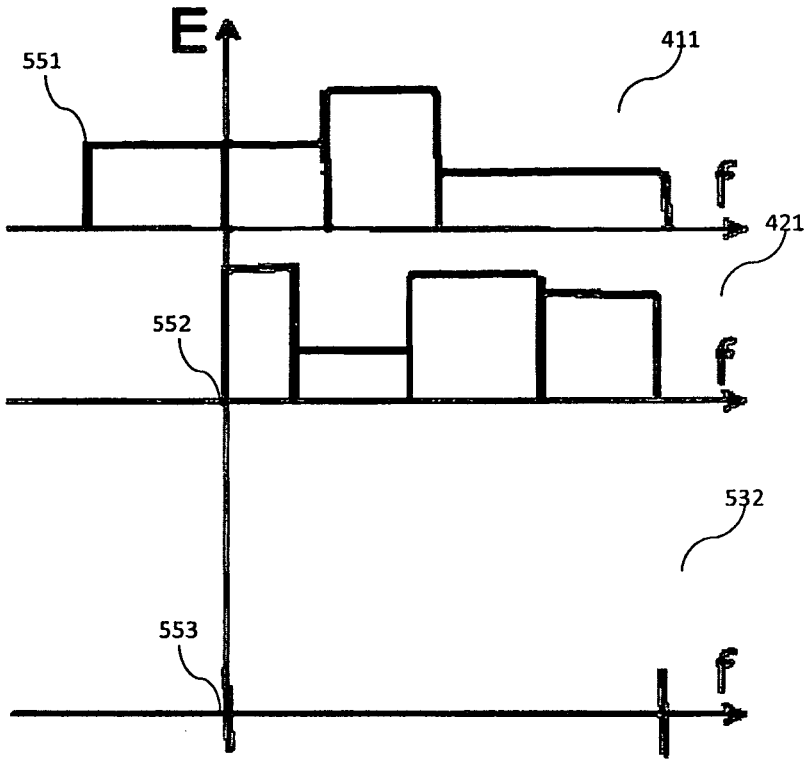

Furthermore, it should be noted that the start frequencies of the contributing source envelopes 411, 421 may be different. As outlined above, the start frequency of the target set 206 is typically selected to be the largest start frequency of the contributing source sets 201, 202. In an embodiment, the start frequency of the target set 206 may be selected to be the largest start frequency of all source sets 201, 202, 204 which contribute to the final target set 208 of the SBR parameter merging unit 112 (as outlined above in the context of the merging of the SBR element header). As a consequence, not the complete frequency range of the spectral envelopes 411, 421 of the source sets 201, 202 may contribute to the spectral envelope 532 of the target set 206, which is also referred to as the target envelope 532. This is illustrated in FIG. 5*b*, where the spectral envelopes 411, 421 of the source sets 201, 202 are shown. In the illustrated example, the spectral envelope 411 has a start frequency 551 which is lower than the start frequency 552 of the spectral envelope 421. If the higher start frequency 552 is selected as the start frequency 553 of the target envelope 532, then the spectral envelope 411 may be truncated. This is due to the fact that the scale factor bands in the frequency range between the lower start frequency 551 and the higher start frequency 552 will typically not contribute to the target envelope 532. As such, the "truncating" of the spectral envelope 411 may be achieved by ignoring the frequency range between the lower start frequency 551 and the higher start frequency 552 during the merging process.

In general, it may be stated that the source envelopes 512, 522 contributing to the target envelope 532 may be truncated such that their frequency range corresponds to the frequency range of the target envelope 532. In particular, the frequency bands or one or more portions of frequency bands lying below the start frequency and above the stop frequency of the target envelope 532 may be truncated. In the following, it has been assumed that the contributing source envelopes 512, 522 have been truncated as outlined above, such that their start and/or stop frequencies correspond to the start and/or stop frequencies of the target envelope 532.

Typically, the scale factor band partitioning of the first source envelope 512 does not correspond to the scale factor band partitioning of the second source envelope 522. In other words, the frequency bands with constant energy, i.e. the frequency bands with constant scale factor energies, are different for the different source envelopes 512, 522. This is illustrated in FIG. 5*a*, where the border frequencies 513, 514 of the first source envelope 512 are different from the border frequencies 523, 524, 525 of the second source envelope 522. In addition, the number of scale factor bands in the first source envelope 512 (three in the illustrated example) may be different from the number of scale factor bands in the second source envelope 522 (four in the illustrated example). Furthermore, the source envelopes 512, 522 may comprise different levels of energies depending on the frequencies. The scale factor energies determination unit 302 is operable to determine the target envelope 532 from the contributing source envelopes 512, 522, wherein the target envelope 532 comprises one or more scale factor bands and respective scale factor energies.

In the following, the merging of the scale factor energies corresponding to the scale factor bands of the source envelopes 512, 522 will be described. The underlying idea is to provide a joint frequency grid between the plurality of source envelopes 512, 522 and the target envelope 532. Such a joint frequency grid may be provided by the QMF (quadrature mirror filter) subbands of the analysis/synthesis filter banks used in SBR based codecs. Using the joint frequency grid, e.g. the QMF subbands, the scale factors of the contributing source envelopes which correspond to the same QMF subband are added to provide a cumulative scale factor energy of the corresponding QMF subband of to the target envelope. Eventually, the cumulative scale factor energy may be divided by the number of contributing source sets, in order to provide an average scale factor as the scale factor energy of the corresponding QMF subband of the target envelope.

Figure 5C:
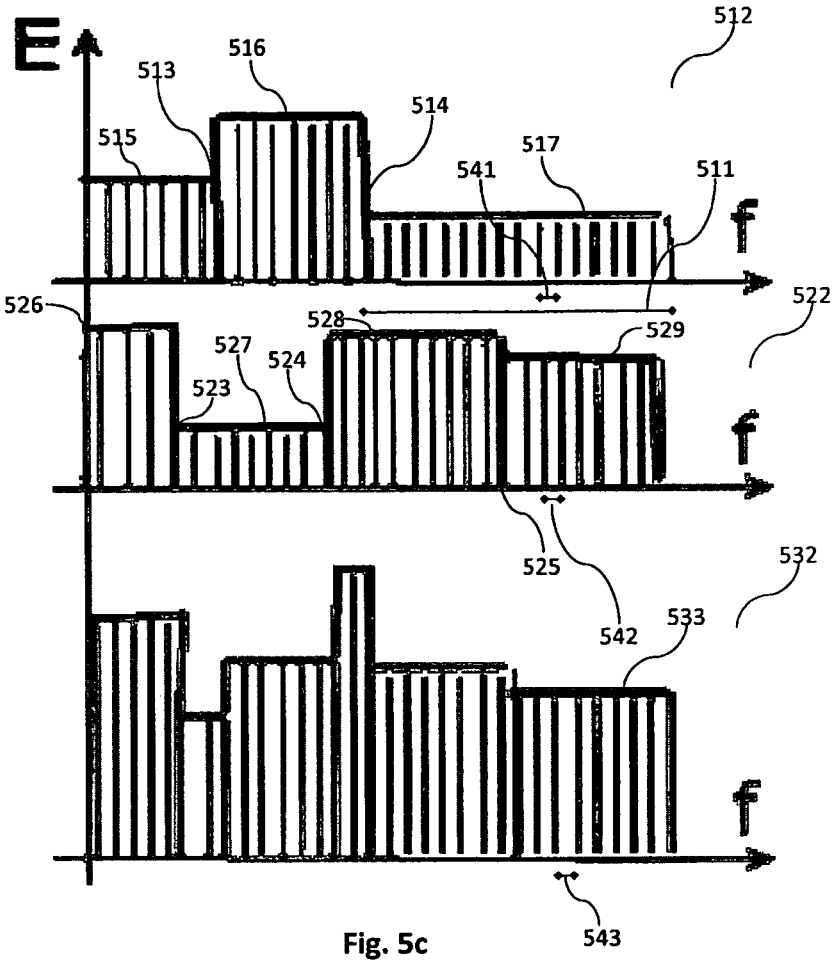
Figure 5D:
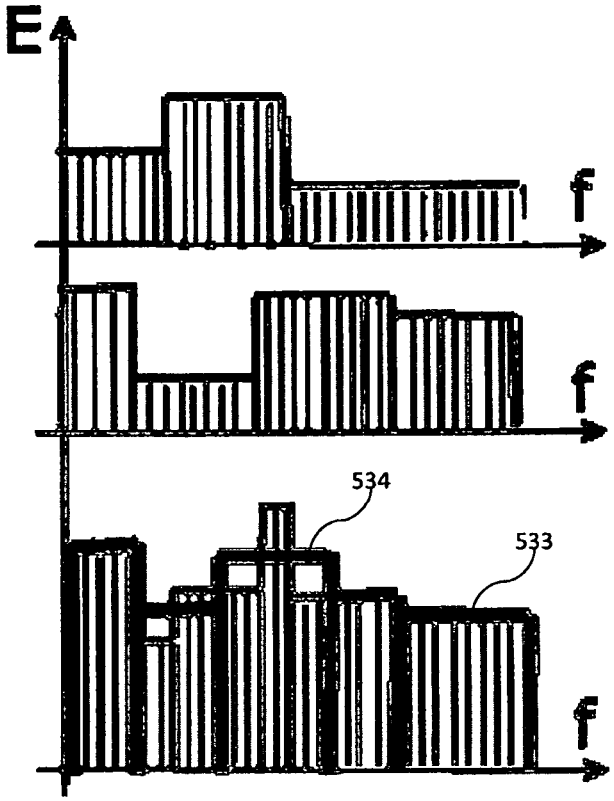

This merging process of scale factor energies is shown in FIGS. 5*c* and 5*d*. FIG. 5*c* illustrates the plurality of scale factor energies 515, 516 and 517 associated with source envelope 512, as well as scale factor energies 526, 527, 528 and 529 associated with source envelope 522. For each source envelope 512, 522 that is mixed into the target envelope the following steps are executed. The steps are described for a certain scale factor band 511. In particular, the steps are outlined for a certain QMF subband 541 within the scale factor band 511. The steps should be performed for all QMF subbands 541 which lie within the frequency range of the target envelope 532.

In a first step, the scale factor energy 517 of each scale factor band 511 may be scaled by a corresponding, energy compensated, downmix coefficient for the channel corresponding to the source set 201. The determination of the energy compensated downmix coefficients will be outlined at a later stage.

As outlined above, each source scale factor band 511 is broken down into QMF subbands 541, i.e. the scale factor bands 511 are broken down into the joint frequency grid. Each QMF subband 541 of a scale factor band 511 is assigned the scale factor energy 517 of the respective scale factor band 511. In other words, the QMF subband 541 is assigned the scale factor energy 517 of the scale factor band 511 within which it lies. The representation of the scale factor bands 511 and the corresponding scale factor energies 517 on the grid of the QMF subbands 541 is referred to in the following as the "QMF representation".

In a following step, the source QMF representation is added to the corresponding target QMF representation of the target channel. In the example illustrated in FIG. 5*c*, the scale factor energy 517 of the QMF subband 541 of the source set 201 is added to the scale factor energy 533 of the corresponding QMF subband 543 of the target envelope 532. In a similar manner, the scale factor energy 529 of the QMF subband 542 of the source set 202 is added to the scale factor energy 533 of the corresponding QMF subband 543 of the target envelope 532. Eventually, the cumulative scale factor energy 533 may be divided by the number of contributing source sets 201, 202, to yield an average scale factor energy 533.

It should be noted that as a result of removing start/stop time borders during the envelope time border determination process in unit 301, it may happen that the time interval 503 of the target envelope 532 covers several envelopes of the first and/or second source set 201, 202. This aspect of multiple contributing envelopes 411 of a source set 201 has already been indicated above. In the following, it will be described how such multiple source envelopes can be considered in the scale factor energies determination unit 302. The general idea is to consider each contributing source envelope of a source set 201 in accordance to its partial contribution. A source envelope of a source set may overlap only partially with the time interval of a target envelope. In other words, the time interval of a target envelope may span several envelopes of a source set, such that each envelope of the source set only covers a fraction of time of the time interval of the target envelope. Such fractional contribution may be taken into account by scaling the scale factor energies of the contributing envelopes of the source set in accordance to the fraction of time they contribute to the time interval of the target envelope. If the time axis is subdivided into time slots, the scaling of the scale factor energies may be performed in accordance to the ratio of the overlapping time slots, i.e. the overlapping time slots of the respective source envelope and the target envelope, to the number of time slots comprised in the time interval of the target envelope.

The partial contribution may be illustrated in FIG. 4. The time interval [416,427] of the target set 206 comprises the source envelopes 413, 414 of the first source set 201 and the source envelopes 422, 423 of the second source set 202. In such cases, all source envelopes 413, 414, 422, 423 of the first and second source set 201, 202, which contribute to a target envelope 531 of the target set 206, should be considered for the merging of the scale factor energies. The scale factor energies within the scale factor bands of the different source envelopes 413, 414, 422, 423 should contribute partially according to the ratio given by the number of overlapping time slots of the contributing envelope 413, 414, 422, 423 and the time interval [416,427] of the target envelope, and the number of time slots of the time interval [416, 427] of the target envelope. This aspect of considering a partial contribution of the source envelopes 413, 414, 422, 423 to the target envelope may be used in the process for merging the scale factor energies described above. In particular, the scaled scale factor energies of the contributing source envelopes 413, 414, 422, 423 may be added to determine the cumulative scale factor energy 533 of the QMF subband 543 of the target envelope 532.

As an outcome of the above process, target scale factor bands for the target envelope 532 are obtained. Depending on the number of contributing source envelopes 512, the number of scale factor bands 511 comprised within the source envelopes 512 and the position of the frequency borders 513 between the scale factor bands 511, the number of scale factor bands for the target envelope 532 may be relatively high. It may be beneficial to reduce the number of scale factor bands within the target envelope 532, e.g. due to limitations of the underlying coding scheme and/or due to a pre-determined scale factor band partitioning or structure.

By way of example, if the target set 206 uses an SBR element header of one of the source sets 201, 202, then the scale factor band structure of the respective source set 201, 202 may be used. As has been outlined in the context of a method for merging the SBR element headers of a plurality of source sets, the SBR element header of a target set may correspond to or may be based on the SBR element header of one of the source sets. In addition to specifying the start and/or stop frequencies of the spectral envelopes comprised within the respective set of SBR parameters, the SBR element header may also specify the scale factor band structure of the spectral envelopes. This scale factor band structure may be used for the target envelope determined in the scale factor energy merging process outlined above. In the following, a method is described for how the scale factor band structure obtained from the merging process, also referred to as the first scale factor band structure, may be converted into a predetermined scale factor band structure, e.g. a structure given by the SBR element header of the target set 206, which is referred to as the second scale factor band structure.

For the conversion from a first scale factor band structure to a second scale factor band structure, the following process may be used, which is outlined with reference to FIG. 5*d*. The process is outlined for a particular scale factor band of the second scale factor band structure and should be performed for all the scale factor bands of the second scale factor band structure. The process relies on a frequency grid, e.g. the QMF subbands 543.

In a first step, the scale factor energies 533 of all QMF subbands 543 in a scale factor band of the second scale factor band structure are summed up. As outlined above, the target scale factor band partitioning, i.e. the second scale factor band structure, may be determined by the SBR element header that has been selected during the merging process of the SBR element headers.

The sum of the QMF subband energies calculated in the first step is divided by the number of QMF subbands that have been summed. In other words, the average scale factor energy 534 of a scale factor band of the second scale factor band structure is determined. The result is the target scale factor energy 534 of the respective scale factor band. This process is repeated for the other scale factor bands of the second scale factor band structure.

In summary, a process for determining the scale factor energies in a target scale factor band structure of a target envelope 532 has been described. By using the above merging process for all target envelopes 532 of the target set 206, the complete set of merged scale factor energies of the envelopes of the target set 206 can be obtained. The described process may be generalized to an arbitrary number of source sets 201. In such cases, an arbitrary number of source envelopes may contribute to a target envelope 532. The contributing source envelopes are broken up using the joint frequency grid, e.g. the QMF subbands, and the source scale factor energies of corresponding QMF subbands are summed up to determine a target scale factor energy of the corresponding QMF subband. The target scale factor energy may be normalized with the number of contributing source sets. If a source envelope of a source set only contributes partially, the scale factor energies may be scaled in accordance with the method outlined above. Furthermore, the scale factor energies may be weighted by energy compensated downmix factors. Eventually, the determined scale factor energies and the scale factor band structure may be converted into a predetermined scale factor band structure.

It should be noted that the source sets 201, 202 may specify noise floor levels. Such noise floor levels of different source channels may be merged in a similar manner as the scale factor energies. In such cases, the scale factor energies correspond to noise floor levels and the envelope time borders correspond to noise floor borders. It should be noted, however, that the number of time intervals for noise are typically lower than the number of envelopes. In an embodiment, only two noise time intervals may be defined within a frame using a start border, a stop border and a middle border. Within such noise time intervals one or more noise floor levels and a corresponding frequency band structure (or noise floor scale factor band structure) may be specified. The start border, stop border and/or middle borders of a plurality of source sets 201 may be merged using the process outlined in relation to FIG. 4. The one or more noise floor levels of a plurality of source sets 201 may be merged using the process outlined in relation to FIGS. 5*a*-5*d*.

It should be noted, however, that typically the noise floor levels are not scaled by the energy compensated downmix coefficients. Nevertheless, the contributing source noise floor levels and/or the target noise floor levels may be scaled in order to fine-tune the subjective audio quality of the merged audio channels.

Figure 6:
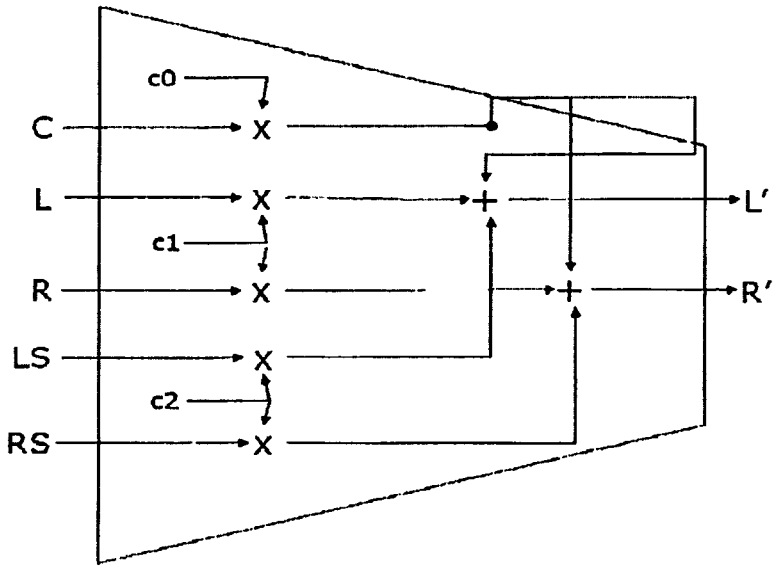
FIG. 6 illustrates an exemplary weighting scheme of source channels with downmix coefficients.

In the context of the scale factor energies merging method, it has been indicated that it may be beneficial to apply downmix coefficients to the source channels. Such downmix coefficients are typically applied to the low band signals to provide clipping protection for the downmixed channels. FIG. 6 shows the application of downmix coefficients to the low band signals of corresponding audio channels. It can be seen that the C-channel is weighted or scaled with a downmix coefficient $c_0$, the R- and L-channels are weighted with a downmix coefficient $c_1$ and the LS- and RS-channels are weighted with a downmix coefficient $c_2$. In the context of a downmix from five channels to two channels, the downmix coefficients may be specified as follows: $c_0$=0.7/scale, $c_1$=1.01 scale, $c_2$=0.5/scale, wherein scale=0.7+1.0+0.5=2.2. These coefficient values correspond to a recommendation of the International Telecommunication Union (ITU) for the downmix of a 5.1 channel signal. These coefficients may also be used if less than five channels are downmixed (e.g. only the left, right and center channel).

In a similar manner to the low band signal, it may be beneficial to weight the scale factor energies of the source channels or the source sets 201, 202 with downmix coefficients. This may be important to maintain the ratio between the low frequency component and the high frequency component of an audio signal. In particular, it may be important to maintain the ratio of the energy of the low frequency component and the high frequency component. In this context, FIG. 6 illustrates a single step downmix of five input channels to two output channels. The downmix coefficients are directly applied to the input channels. In an alternative embodiment, a hierarchical downmix as shown in FIG. 2 may be used, whereby the downmix coefficients would be applied directly on the input channels 201, 202, 203, 204, 205.

It should be noted, however, that source channels in the time domain may be in-phase or anti-phase, such that the downmixed target channel in the time domain may be amplified or attenuated depending on the phase relation. In order to take this effect into account when merging the scale factor energies, the above downmix coefficients may be multiplied with an energy compensation factor which takes into account the in-phase and/or anti-phase behavior of the audio signals of the contributing source channels. In particular, the energy compensation factor takes into account the attenuation or amplification of a downmixed low band audio signal incurred relative to the contributing low band audio signals. For a given frame of the audio signal an energy compensation factor may be calculated according to the equation below:

$$f_{comp} = \sqrt{\frac{\sum_{chout=0}^{M-1} \sum_{n=0}^{1023} x_{dmx}^2[chout][n]}{\sum_{chin=0}^{N-1} \sum_{n=0}^{1023} (c_{chin} \cdot x_{in}[chin][n])^2}}$$

wherein $f_{comp}$ is the compensation factor for the downmix coefficients, $x_{in}$[chin][in] is the low band time domain signal in the source channel chin (channel in), $c_{chin}$ is the downmix coefficient (e.g. $c_0$,$c_1$,$c_2$ of FIG. 6) for the channel chin, $x_{dmx}$[chout][n] is the low band time domain signal of the target channel chout (channel out), and n=0, . . . , 1023 is the sample index of the samples within a frame. The equation calculates the energy of the available samples of one frame. In particular, the equation determines the ratio between the energy of the target channels and the energy of the source channels, wherein the source channels are weighted by their respective downmix coefficient. In many cases an energy estimate with lower accuracy, e.g. using only a fraction of the available samples, may be sufficient to determine an appropriate energy compensation factor.

Using an energy compensation factor, the energetic balance between the low frequency component and the high frequency component of the audio signals of the different audio channels may be maintained. This may be achieved by taking into account the positive and/or negative contribution of the signals of the source channels to the downmixed signal of the downmix channel. It should be noted that in downmix systems which provide M output channels from N input channels, it is possible to provide a single energy compensation factor for the complete system. Alternatively or in addition, a plurality of energy compensation factors may be determined. By way of example, a dedicated energy compensation factor may be determined for each of the M downmixed output channels. This could be done by considering only the input channels which contribute to the respective output channel. In a further example, a dedicated energy compensation factor could be determined for each elementary merging unit 210.

The downmix coefficients c that have been used to produce the time domain downmix of the AAC decoder output, e.g. $c_0$, $c_1$ and $c_2$ specified above, may be multiplied with this energy compensation factor $f_{comp}$ in order to yield energy compensated downmix coefficients. Prior to merging the scale factor energies of the source sets 201, 202, the scale factor energies 517 may be weighted or scaled with the respective energy compensated downmix coefficient as outlined above. In view of the fact that the downmix coefficients c have been defined for time-domain signals, the scale factor energies 517 should be scaled with the square value of the energy compensated downmix coefficient, i.e. $(f_{comp}*c_{chin})^2$, of the respective source channel. As such, it should be noted that the computation of $(f_{comp})^2$ may be sufficient. Typically, this should be more efficient as the square root operation for the determination of $f_{comp}$ may be omitted.

Typically, the downmix coefficients c are scaled or normalized as outlined above, such that they add up to a constant value, e.g. one. In case of a scaling to a value one, the range of the scaled downmix coefficients is limited to [0.01; 1]. However, in view of the fact that the downmix coefficients are used to specify the relative weighting of the different source channels, a different constant value can be selected for normalization. Consequently, the above limit values may be increased or lowered in accordance to the constant normalization value, provided that the relative ratio between the downmix coefficients is maintained.

It should be noted that in an alternative embodiment, the energy compensation may be applied to the low band downmix signal. This is due to the fact that the energy compensation factor is applied to maintain the balance between the high band signals and the low band signals. This balance can also be maintained by applying the inverse energy compensation factor to the downmixing stage of the downmix signal. In such an embodiment, the downmix coefficients used for the scale factor energies would remain unchanged, i.e. they would not be subject to any downmix compensation.

In the present document, methods and systems for downmixing SBR parameters have been described. The described methods and systems allow for the implementation of a generic merging process to produce SBR parameters for M channels from SBR parameters of N channels, wherein M<N. In particular, the methods and systems allow for the merging of SBR parameters of channels with different start/stop frequencies. Furthermore, the method and systems allow for the merging of SBR parameters of channels with different scale factor band partitioning. In addition, a scheme for the accurate merging of transient envelope information has been described. Furthermore, a hierarchical merging process is described which makes it possible to adaptively handle multiple channel configurations. In addition, an adaptive energy compensation scheme has been described, which dampens or boosts the SBR energies, in order to match the energy of the reconstructed high band signal with the energy of the low band signal of the downmixed signal. Through the use of such a compensation scheme, the in-phase and/or anti-phase behavior of different audio channels during the downmixing stage in the time-domain can be compensated directly in the encoded domain.

The methods and systems for downmixing described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g. the internet. Typical devices making use of the methods and systems described in the present document are portable electronic devices or other consumer equipment which are used to store and/or render audio signals. The methods and systems may also be used on computer systems, e.g. internet web servers, which store and provide audio signals, e.g. music signals, for download.

The invention claimed is:

1. A method for merging a first and a second source set of spectral band replication parameters, in the following referred to as SBR parameters, to a target set of SBR parameters, wherein the first and second source set comprise a first and second frequency band partitioning, respectively, which are different from one another;

the first source set comprises a first set of energy related values associated with frequency bands of the first frequency band partitioning;

the second source set comprises a second set of energy related values associated with frequency bands of the second frequency band partitioning; and the target set comprises a target energy related value associated with an elementary frequency band;

the method comprising:

breaking up the first and the second frequency band partitioning into a joint grid comprising the elementary frequency band;

assigning a first value of the first set of energy related values to the elementary frequency band;

assigning a second value of the second set of energy related values to the elementary frequency band; and combining the first and second value to yield the target energy related value for the elementary frequency band.

2. The method of claim 1 wherein the first value corresponds to the energy related value associated with a frequency band of the first frequency band partitioning which comprises the elementary frequency band; and the second value corresponds to the energy related value associated with a frequency band of the second frequency band partitioning which comprises the elementary frequency band.

3. The method of claim 1, wherein the joint grid is associated with a quadrature mirror filter bank, referred to as QMF filter bank, used to determine the SBR parameters; and the elementary frequency band is a QMF subband.

4. The method of claim 1, further comprising:

normalizing the target energy related value by the number of contributing source sets.

5. The method of claim 1, wherein the target set comprises a set of target energy related values; and wherein the method further comprises:

repeating the assigning steps and the combining step for all elementary frequency bands of the joint grid, thereby yielding the set of target energy related values.

6. The method of claim 1, wherein the energy related values are scale factor energies and the frequency bands are scale factor bands; and/or the energy related values are noise floor scale factor energies and the frequency bands are noise floor scale factor bands.

7. The method of claim 1, wherein the first source set is associated with a first low band signal of a first source channel;

the second source set is associated with a second low band signal of a second source channel; and the target set is associated with a target low band signal of a target channel obtained from time-domain downmixing of the first and second low band signal.

8. The method of claim 7, wherein the target energy related value is associated with a target time interval of the target low band signal;

the first set of energy related values is associated with a first time interval of the first low band signal, wherein the first time interval overlaps the target time interval; and the combining step comprises: scaling the first value in accordance to a ratio given by the length of the overlap of the first time interval and the target time interval, and the length of the target time interval; and combining the scaled first value and the second value.

9. The method of claim 7, further comprising:

scaling the first set of energy related values by a first downmix coefficient; and scaling the second set of energy related values by a second downmix coefficient;

wherein the first and second downmix coefficient are associated with the first and second source channel, respectively.

10. The method of claim 1, wherein the first source set comprises a first start frequency;

the second source set comprises a second start frequency;

the first and second start frequency are different and are associated with lower bounds of the first and second band partitioning, respectively; and wherein the method comprises further:

comparing the first and second start frequencies;

selecting the higher or lower of the first and the second start frequency as a start frequency of the target set.

11. The method of claim 1, wherein the first source set comprises a first transient envelope index; wherein the first transient envelope index identifies a first transient envelope with a first start time border;

the second source set comprises a second transient envelope index; wherein the second transient envelope index identifies a second transient envelope with a second start time border;

the target set comprises a plurality of target envelopes, each target envelope having a start time border;

the first transient envelope, the second transient envelope and the plurality of target envelopes are associated with one or more time intervals of a first source signal, second source signal and target signal, respectively;

the method comprising further:

selecting the earlier one of the first and second start time borders;

determining as a target transient envelope the envelope of the plurality of target envelopes for which the start border time is closest to the earlier one of the first and second start time borders; and setting a target transient envelope index to identify the target transient envelope.

12. A method for merging N source sets of SBR parameters to M target sets of SBR parameters, wherein N is greater than 2;

M is smaller than N;

the method comprising:

merging a pair of source sets to yield an intermediate set; and merging the intermediate set with a source set or another intermediate set to yield a target set;

wherein the merging steps are performed according to the method of claim 1.

13. A non-transitory storage medium comprising a software program adapted for execution on a processor and for performing the method steps of claim 1 when carried out on a computing device.

14. An SBR parameter merging unit configured to provide M target sets of SBR parameters from N source sets of SBR parameters, wherein $N>M\geq 1$, the SBR parameter merging unit comprising a processor configured to perform the method steps of claim 1.

15. A method for merging a first and a second source set of SBR parameters to a target set of SBR parameters, wherein the first source set is associated with a first low band signal of a first source channel and comprises a first set of scale factor energies;

the second source set is associated with a second low band signal of a second source channel and comprises a second set of scale factor energies;

the target set is associated with a target low band signal of a target channel obtained from time-domain downmixing of the first and second low band signal; and the target set comprises a target set of scale factor energies;

the method comprising:

weighting a first and a second downmix coefficient by an energy compensation factor; wherein the first downmix coefficient is associated with the first source channel; wherein the second downmix coefficient is associated with the second source channel; wherein the energy compensation factor is associated with the interaction of the first and second low band signal during time-domain downmixing;

scaling the first set of scale factor energies by the first weighted downmix coefficient;

scaling the second set of scale factor energies by the second weighted downmix coefficient; and determining the target set of scale factor energies from the scaled first set of scale factor energies and the scaled second set of scale factor energies.

16. The method of claim 15, wherein the energy compensation factor is associated with the ratio of the energy of the target low band signal and the combined energy of the first and second low band signal.

17. A method for merging a first and a second source set of SBR parameters to a target set of SBR parameters, wherein the first source set comprises a first transient envelope index; wherein the first transient envelope index identifies a first transient envelope with a first start time border;

the second source set comprises a second transient envelope index; wherein the second transient envelope index identifies a second transient envelope with a second start time border;

the target set comprises a plurality of target envelopes, each target envelope having a start time border;

the first transient envelope, the second transient envelope and the plurality of target envelopes are associated with one or more time intervals of a first source signal, second source signal and target signal, respectively;

the method comprising:

selecting the earlier one of the first and second start time borders;

determining as a target transient envelope the envelope of the plurality of target envelopes for which the start time border is closest to the earlier one of the first and second start time borders; and setting a target transient envelope index to identify the target transient envelope.

18. The method of claim 17, wherein the determining step comprises determining as a target transient envelope the envelope of the plurality of target envelopes for which the start time border is closest to the earlier one of the first and second start time borders but not later than the earlier one of the first and second start time borders.

* * * * *